United States Patent [19]

Roos

[11] Patent Number: 4,882,010

[45] Date of Patent: Nov. 21, 1989

[54] METHOD FOR BURNING EVAPORATED WASTE LIQUOR

[75] Inventor: Tom O. M. Roos, Grankulla, Finland

[73] Assignee: Stiftelsen Cellulosa-Och Pappersforskning, Sweden

[21] Appl. No.: 145,693

[22] Filed: Jan. 15, 1988

Related U.S. Application Data

[63] Continuation of Ser. No. 918,947, filed as PCT SE86/00015 on Jan. 17, 1986, published as WO86/04366 on Jul. 31, 1986, abandoned.

[30] Foreign Application Priority Data

Jan. 22, 1985 [SE] Sweden ..... 8500281

[51] Int. Cl.[4] ..... D21C 11/12; D21C 11/14; F23L 1/00; F23G 7/04

[52] U.S. Cl. ..... 162/30.1; 162/30.11; 110/238; 110/244; 110/348

[58] Field of Search ..... 162/30.1, 30.11; 110/243, 245, 238, 348, 244, 260; 423/207

[56] References Cited

U.S. PATENT DOCUMENTS

| | | | |
|---|---|---|---|
| 3,867,251 | 2/1975 | Holme | 162/30 |
| 4,350,101 | 9/1982 | Prudhon et al. | 110/238 |
| 4,462,319 | 7/1984 | Larsen | 110/238 |
| 4,562,778 | 1/1986 | Bernard et al. | 110/238 |

FOREIGN PATENT DOCUMENTS

| | | | |
|---|---|---|---|
| 33452 | 10/1963 | Finland | 162/30.1 |
| 332678 | 2/1971 | Sweden | 162/30.1 |
| 80064561 | 9/1980 | Sweden . | |

*Primary Examiner*—Steve Alvo
*Attorney, Agent, or Firm*—Townsend and Townsend

[57] ABSTRACT

In a method for burning evaporated waste liquor obtained at pulp production in accordance with cooking processes on sodium basis for recovering sodium carbonate and sulphide, the liquor (10) is injected towards the inlet end side (4) of a cylinder-shaped reaction chamber with mainly tangential gas supply (6). In this cyclone (2) the liquor is dried and pyrolysed by hot fumes recirculated from the outlet portion (12) and obtained through the ejector action of the liquor injection. After ignition of the pyrolysis gas and rests of the liquor the formed smelt (16) is discharged after sulphuration from the outlet portion of the cyclone. The fumes of the cyclone are oxidized in a separate furnace (14) after the cyclone (2). A stable and, from a process technical point of view, suitable combustion without support firing with any other fuel can be maintained with liquor including 25-40 % of water.

1 Claim, 1 Drawing Sheet

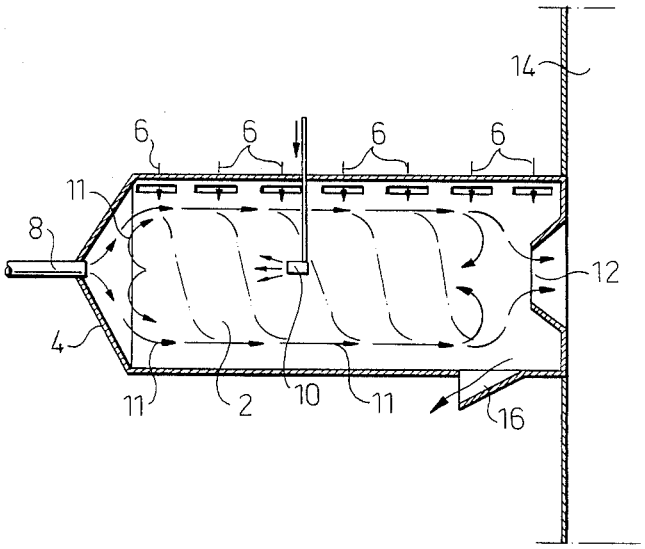
14
6
6
6
6
11
8
12
4
11
2
10
11
16

METHOD FOR BURNING EVAPORATED WASTE LIQUOR

This is a continuation of application Ser. No. 918,947, filed as PCT SE86/00015 on Jan. 17, 1986, published as WO86/04366 on Jul. 31, 1986, now abandoned.

The present invention relates to a method for recovering sodium carbonate and sulphide in connection with burning evaporated waste liquor obtained at pulp production in accordance with cooking processes on sodium basis, wherein the liquor is injected into a cyclone furnace in the form of an essentially cylinder shaped reaction chamber with mainly tangential gas supply, in which the liquor is dried, pyrolysed and in part burned while forming a salt smelt which after sulphuration is discharged from the cyclone, and the formed gas is withdrawn at an outlet end of the reaction chamber in order to be fed to a separate furnace.

The commonly used soda recovery unit for burning evaporated black liquor for producing heat and recovering the chemicals has a number of wellknown drawbacks, among which can be mentioned the difficulties to control the emission of evil smelling gases and gases dangerous to the environment, and a risk for explosions in connection with water leaking into the furnace of the soda recovery unit. Attempts have been made to eliminate these drawbacks.

In the Swedish Pat. No. 7204304-5 a recovery process of the kind defined by way of introduction is described. By replacing the earlier boiler here with a cyclone apparatus it has turned out that one to a great extent can control the reaction processes and thereby also the emission of evil smelling gases. Furthermore, the amount of smelt in the cyclone apparatus is essentially less than in the furnace of the conventional soda recovery unit. An assumption for the good result is a good control over the process conditions in the cyclone.

Also in the Swedish patent application 8006456-1 a recovery process of essentially the kind as defined by means of introduction is disclosed. At the inlet end of the cyclone apparatus a specially formed burner is arranged for injecting evaporated waste liquor and/or oil. More particularly the burner is realized so as to tend to give the combustion gases such a flow pattern that a recirculation zone is generated in the portion of the cyclone located most closely to the burner. Thereby one obtains a prolonged dwelling time of the reaction components in this zone. After the first zone follows a second zone aerodynamically separated therefrom and likewise characterized by recirculation.

The object of the present invention is to try to further control the process conditions in a cyclone apparatus of the type used in connection with the processes according to the above-mentioned patent specifications. According to the invention this is attained in a surprisingly simple way thereby that at least a portion of the liquor is injected by means of a nozzle arrangement located inside the cyclone furnace at a distance from the walls thereof and arranged to direct the liquor in a direction from the outlet end.

The invention is based upon a flow principle securing effective drying, pyrolysis and burning of the liquor without additional fuel. At the combustion in a cyclone of the kind intended above the hottest fumes are formed in the portion of the cyclone where smelting and sulphuration is taking place, i.e. most closely to the outlet. The liquor nozzle is located inside the cyclone and is directed towards the other end on such a distance therefrom that the drying and pyrolysis of the liquor is mainly taking place in the front portion of the cyclone. Hot fumes are recirculated from the outlet end by means of the ejector action of the liquor nozzle and are furthermore mixed very effectively with the liquor before the liquor droplets hit the walls of the cyclone in the front portion of the cyclone. Differing from the principle described in the patent application 8006456-1 the cyclone is not divided, from a flow point of view, into two parts, but recirculation of the fumes only takes place from the hot rear portion of the cyclone.

By means of the invention a stable combustion process of liquor with "normal" dry contents (60–70%) without oil support is made possible. To the intense drying process also the heavily turbulent mixing of the liquor droplets and the hot fumes, before the liquor droplets hit the cyclone walls, contributes, whereafter drying of the liquor on the walls is taking place considerably slower. Although it is not theoretically clarified how drying, pyrolysis and burning of the black liquor takes place in a cyclone furnace with the flow process here stated, practical experiments have shown that one obtains a stable combustion without addditional firing with other fuel such as oil.

BRIEF DESCRIPTION OF THE DRAWING

The invention is explained more closely below in connection with the drawing that schematically and in section illustrates a plant for carrying through the method according to the invention.

DETAILED DESCRIPTION OF INVENTION

The arrangement shown in the Drawing includes a cyclone furnace 2 in the form of a mainly cylindric chamber with conical inlet end 4. In the envelope surface of the cylinder tangentially directed nozzles 6 are located for blowing in air in a tangential direction. A burner 8 with means, not shown, for feeding in starting fuel and air is located in the conical inlet end. The liquor is introduced in the middle or near the middle of the cyclone by means of a nozzle device 10 directed towards the centre of the conical inlet 4. In the cyclone for the rest the cyclone contents, i.e. gases as well as solid flowing particles, is imparted a tangential and axial movement, indicated by flow lines and arrows 11, for leaving through an essentially coaxial outlet 12. As the flow lines and arrows indicate, the gases and solid particles flow in a circulating path which includes a spiral portion along the inner wall of the chamber flowing generally from left to right and an axial portion along the axis of the chamber flowing from right to left. This leads to a furnace 14 of the type included in a conventional industrial soda recovery unit. The smelt is discharged through a smelt channel 16 immediately before the outlet of the cyclone.

As regards the closer details, with the exception of the nozzle device 10 of the cyclone furnace, and the chemical and physical processes present in the cyclone furnace, reference is made to the above-mentioned Pat. No. 7204304-5. The essential difference with respect to that what is described therein and in the patent application 8006456-1, lies in the fact that one according to the invention, thanks to the effective hot recirculation gases from the outlet portion of the cyclone to the inlet portion of the cyclone, attains a faster drying and pyrolysis, and thereby a stable combustion without added fuel.

Measurements in connection with operation of a testing plant have shown that the following values can be regarded as realistic and representative of a device utilizing the method according to the invention.

Reduction of the smelt 85–98%.

Sulphur in the fumes 8–20% of that fed in.

Sodium in the fumes 5–10% of that fed in, i.e. on a level with the conventional soda recovery unit or better.

A stable and, from a process technical point of view, suitable combustion without support firing with other fuel and can be obtained with liquor including 25–40% of water.

I claim:

1. A method for recovering sodium carbonate and sodium sulphide values from waste liquor produced by sodium-based pulp production processes, said method consisting essentially of:

(a) feeding fuel and combustion air to a cylindrical reaction chamber having a conical first end wall and a second end wall at the end of the reaction chamber and a cylindrical wall therebetween, to heat said reaction chamber to a temperature sufficient to effect drying and pyrolysis of said waste liquor; and (b) once said temperature is achieved, performing the following without feeding further fuel:

(i) feeding air to said reaction chamber through air inlets located along said cylindrical wall arranged along the entire length thereof to provide substantially tangential flow;

(ii) injecting said waste liquor into said reaction chamber through a nozzle located in the interior thereof, directed toward said first end wall where the fuel and air are fed to the reaction chamber, yet spaced apart therefrom; and (iii) withdrawing product gases from a first outlet port at the center of said second end wall, and product solids from a second outlet port in the vicinity of said second end wall;

such that at least a portion of the gases in said reaction chamber flow in a circulating path extending sustantially the full length of said reaction chamber, said circulating path comprising air and fuel traveling along the conical first end wall toward said cylindrical wall wherein said portion of the gases flow in a spiral path along said cylindrical wall flowing from said first end wall to said second end wall, and an axial portion along the axis of said reaction chamber flowing from said second end wall to said first end wall; and such that said injected waste liquor is mixed with and sufficiently heated by said gases in said circulating path to maintain stable reaction conditions sufficient for substantially complete pyrolysis of said waste liquor without added fuel.

* * * * *